United States Patent [19]

Kawano et al.

[11] 4,148,971

[45] Apr. 10, 1979

[54] FLAME SPRAYING MATERIALS AND PROCESS FOR PRODUCING THE SAME

[75] Inventors: Hideo Kawano; Oelschlagel Dietrich; Katumi Nakata; Kenkichi Yamaji, all of Hitachi, Japan

[73] Assignee: Hitachi Cable, Ltd., Japan

[21] Appl. No.: 830,498

[22] Filed: Sep. 6, 1977

[30] Foreign Application Priority Data

Sep. 8, 1976 [JP] Japan ..... 51-107563

[51] Int. Cl.[2] ..... B05D 1/08; B22F 7/08; B32B 15/02

[52] U.S. Cl. ..... 428/558; 428/576; 428/602; 239/79; 239/83; 29/420.5; 75/208 CS; 75/208 R

[58] Field of Search ..... 428/558, 576, 602; 75/208; 239/79, 83; 29/420.5

[56] References Cited

U.S. PATENT DOCUMENTS

| | | | |
|---|---|---|---|
| Re. 26,611 | 6/1969 | Claussen | 428/558 |
| 2,234,127 | 3/1941 | Mautsch | 428/567 |
| 2,756,492 | 7/1956 | Pettibone | 428/558 |
| 2,888,740 | 6/1959 | Danis | 428/558 |
| 3,322,515 | 5/1967 | Dittrich et al. | 428/558 |
| 3,549,338 | 12/1970 | Sterenbogen et al. | 428/558 |
| 3,921,700 | 11/1975 | Frantzreb et al. | 428/558 |

*Primary Examiner*—Brooks H. Hunt
*Attorney, Agent, or Firm*—Craig & Antonelli

[57] ABSTRACT

A flame spraying material consisting of a wire obtained by compacting zinc powder, zinc-aluminum alloy powder or admixed powders of zinc and aluminum or consisting of a composite wire obtained by enclosing said compacted powders in an aluminum covering.

14 Claims, 7 Drawing Figures

PART (A)

BRIGHTNESS DISTRIBUTION FOR Zn

BRIGHTNESS DISTRIBUTION FOR Aℓ

PART (B)

BRIGHTNESS DISTRIBUTION FOR Zn

BRIGHTNESS DISTRIBUTION FOR Aℓ

SALT SPRAY TEST RESULTS

Zn FLAME SPRAYED SURFACE

Zn−15% Aℓ ALLOY FLAME SPRAYED SURFACE

Zn−26% Aℓ COMPOSITE FLAME SPRAYED SURFACE

FLAME SPRAYING MATERIALS AND PROCESS FOR PRODUCING THE SAME

The present invention relates to flame spraying materials and a process for producing the same. More particularly, the invention pertains to zinc or zinc-aluminum flame spraying materials and a process for producing the same.

Zinc flame spraying has long been utilized in rust prevention and corrosion protection of iron and steel in bridges, steel skeletons, tanks, fittings and couplings, bolts, nuts, vehicle bodies, etc. However, due to steady worsening of environmental conditions, its rust preventing or corrosion protecting effects are not always sufficient, especially in heavy industrialized areas. On the other hand, zinc-aluminum flame sprayed coatings are known to be superior to those of zinc in rust preventing and corrosion protecting effects and can display excellent rust preventing and corrosion protecting effects particularly in severe corrosive environment such as heavy industrialized areas and seaside districts. Also, the rust preventing and corrosion protecting effects of zinc-aluminum flame sprayed coatings are less sensitive to the type of corrosive environment compared with those made by zinc flame spraying. Therefore, it can be said that zinc-aluminum flame spraying is safer and more effective than zinc flame spraying under complex corrosive environments or in cases where the location of installation and therefore the corrosive environment of a flame sprayed part are unknown at the time of flame spraying.

Materials used so far to obtain flame sprayed zinc or zinc-aluminum coatings are solid wires made of pure zinc or zinc-aluminum alloys. These wires have heretofore been produced by casting billets or wire rods of predetermined size and then subjecting said billets or wire rods to hot working followed by cold working to reduce the size of the billets or the wire rods gradually until a flame spraying wire of a predetermined diameter is finally obtained. As zinc or zinc-aluminum alloys are relatively hard and brittle in the cast state, they can not easily be cold worked after casting, but a hot working process has to be included into the working schedule to make final cold working possible.

This conventional process of producing zinc or zinc-aluminum alloy wires for flame spraying has several problems which make the production a difficult and expensive process. First, zinc is known to diffuse easily into steel at elevated temperatures, and through this diffusion the tools used for the hot working operation are embrittled and show a short life. The resulting frequent exchange of the tools is expensive and time consuming. Furthermore in hot working a cast billet or wire rod of zinc, hot working has to be carried out gradually and at relatively low speeds as otherwise, because of the relatively low melting point of zinc, the heat generated during working may cause partial melting of the processed material. A similar problem exists with zinc-aluminum alloys, as those alloys show the phenomenon of hot shortness, whereby the alloys undergo embrittlement and cracking when hot worked at too high speeds or subject to severe working passes. Thus hot working of zinc or zinc-aluminum alloys has low productivity as many working steps are required and the working speed is low.

Also in cold working of these wires, which is usually done by wire drawing, the hardness and poor workability of these materials require the use of only small reductions per drawing dies and therefore a large number of drawing steps are required to obtain the wire of desired diameter. Further the material used to produce flame sprayed coating of zinc-aluminum consists of wires of zinc-aluminum alloys. These alloys are hard and difficult to form, and the hardness and difficulty in forming increase with the aluminum content. For this reason the amount of aluminum contained in the zinc-aluminum alloy wires used for flame spraying is restricted and normally available wires do not contain more than 15% to 20% aluminum. It is however indicated in various studies that the corrosion resistance of zinc-aluminum alloys is more favorable at higher aluminum concentrations and therefore a flame spraying wire, whose structure and manufacturing process do not restrict the amount of aluminum contained in the wire, is desirable.

Further, the hardness of these zinc-aluminum alloy wires causes problems during the operation of flame spraying when used with conventional spraying guns. Feeding of the wire into the spraying gun at a constant speed is difficult to achieve especially if spraying is carried out at restricted places. Slight variations in the feeding speed however impair the quality of the flame sprayed coating.

Therefore, an object of the present invention is to obviate the above-mentioned defects of the prior art.

Another object of the invention is to provide a zinc or zinc-aluminum flame spraying material, which is easy to work and easy to produce in an economic way, and a process for producing the same.

Another object of the invention is to provide a zinc-aluminum flame spraying material having such a structure that a high aluminum concentration can be easily obtained and a process for producing the same.

The other objects and advantages of the present invention will be apparent from the following description taken in conjunction with the accompanying drawings in which:

FIGS. 1 and 4 each are a perspective view of an example of the flame spraying materials according to the present invention.

FIGS. 2 and 5 each are a schematic representation illustrating a process for producing a flame spraying material according to the present invention.

Figure 1:
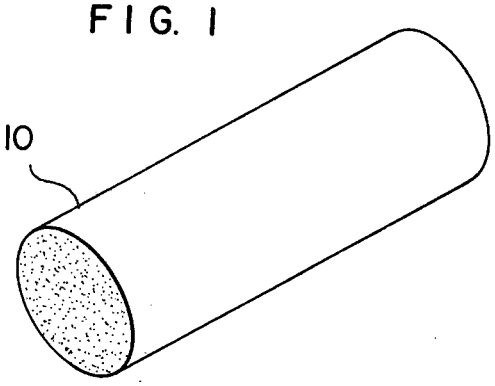

The present invention is based on the findings that zinc or zinc-aluminum wires for flame spraying consisting of compacted powders or of compacted powders enclosed in a sheath of metal can be used in flame spraying in the same way as the solid wires used heretofore and also give flame sprayed coatings of at least the same quality as those made with solid wires of equal composition used heretofore. Especially in the case of zinc-aluminum wires it was found that although the flame sprayed coating should consist of a zinc-aluminum alloy for optimum corrosion protection, the wire used for spray coating may contain the necessary amounts of zinc and aluminum separately in their elemental form and not as an alloy, as alloying of the separate elemental forms is achieved completely during the operation of flame spraying.

According to the present invention, there is provided a flame spraying material consisting of a wire comprising zinc powder or admixed powders of zinc and aluminum or a powder of a zinc-aluminum alloy, whereby the said powders are compacted to give a wire form. Further, the cohesion of these compacted powders may be increased by bonding the particles of the powders to each other metallurgically or by providing an organic binder between the respective particle surfaces.

Also, according to the present invention, there is provided a flame spraying material consisting of a composite wire comprising an aluminum covering and a core comprising a compacted zinc or zinc-aluminum alloy powder or compacted admixed powders of zinc and aluminum.

Said composite wire may be produced by forming an aluminum tape around the said metal powders in the lengthwise direction of the tape and subsequently compressing the metal powders in the tape by a suitable forming or working process.

In the composite wire, the amount of aluminum in the metal powder or metal powders constituting the core and the thickness of the aluminum tape covering determine the amount of aluminum in the whole composite wire. In other words, even when the thickness of the aluminum tape covering is constant, composite wires having different aluminum concentrations can be easily obtained by varying the amount of aluminum in the metal powder or metal powders core.

It is important in the flame spraying of the above composite wire that during flame spraying the wire melts homogeneously and forms an alloy of the composition given by the amount of the zinc and aluminum components in the composite wire. In this respect it was found important that the metal of the covering has a higher melting point and a higher thermal conductivity than the core material. This is realized by the wire of the present invention, by providing a covering of aluminum. However, the thickness of the aluminum covering has an important effect and has to be suitably selected. If the thickness of the covering increases, the time required to melt the covering increases and if the covering is too thick, this results in only partial melting of the covering. This impairs the smooth operation of the flame spraying process and leads to fluctuations in the concentration and quality of the flame sprayed coating. It was found that this problem can be avoided by selecting the thickness of the aluminum covering as 0.4 mm or less. Of course, it is necessary to select the thickness of the coating suitably since there is the possibility that the wire is torn off by the air jet used in flame spraying before the coating melts if the thickness of the coating is too small.

According to a process for producing a composite wire for flame spraying according to the present invention, an almost linear joint formed by overlapping of side edges of the aluminum tape covering runs along the axial line of the covering. This joint is formed by the overlapping side edges of an aluminum tape formed into a tubular form. In most cases, this overlapping joint does not open. At an angle thereof on the cross section of the composite wire of less than 45 degrees, it was found, however, that there is the possibility that the joint opens during flame spraying operation, and therefore the angle of overlap as seen in the cross section of the composite wire has to be selected as 45 degrees or more.

Due to the joint on the composite wire formed by the overlapping edges of the tape, the thickness of the covering at the overlap is almost twice that of the covering at the remaining circumference of the wire. For some critical applications this may lead to inhomogeneous melting of the covering during flame spraying. In such cases it is desirable to extend the overlap over the whole circumference of the wire so that the angle of overlap as seen on the cross section of the composite wire is near and around 360 degrees. For example, the angle of overlap can extend between 340° and 380°.

FIG. 1 in the accompanying drawings shows a zinc or zinc-aluminum flame sparying wire according to the present invention, which is produced by compacting a zinc powder or a zinc-aluminum alloy powder or admixed powders of zinc and aluminum. In such a wire the particles of the powders have to be bonded to each other in order to achieve the form of a wire, which can be handled and used in the same way as a conventional flame spraying wire produced from a cast billet or wire rod by hot and cold working. Such a bonding of the particles of the powders can be achieved by either metallurgically bonding the particles to each other during the compaction process or by an organic binder situated between the individual particles. This organic binder is preferably admixed to the powders prior to the compacting process in order to allow sufficient and homogeneous bonding of the particles of the powders. Such binders are burnt off during the flame spraying operation and thus do not impair the quality of the flame sprayed surface. It is however important that these organic binders are not converted into gases upon burning off during the flame spraying, which would obstruct the flame spraying operation. It was found that polyethylene, polyvinyl alcohol or cellulose acetate fulfill these conditions.

Such a wire 10 in FIG. 1 can in principle be produced by any technique for compacting powders known in the art. One would be a conventional extrusion process, where the powder is filled into a container and subsequently forced through a die orifice at one end of the container by a force supplied by a ram acting from the other end of the container. This process and known variations thereof have however the drawback that the powders are completely compacted prior to being forced through the die orifice and as in this process large amounts of cross sectional reductions are applied in one operation this process requires high temperatures and thus causes the same problems as in the case of hot working cast billets or wire rods of zinc or zinc-aluminum alloys for the production of conventional flame spraying wires.

Another process for compacting powders is the powder rolling process. In this process, however, so far, only thin sheets or strips material can be produced and this process is not amendable to the production of wires. Another process which can be used for the production of a wire 10 in FIG. 1 is disclosed in the (Japanese Patent) Kokolu (Post-Exam. Publn.) No. 38316/76. This however is again an extrusion process in which, when adapted to powders, the powders are compacted and forced through a die orifice.

Figure 3:
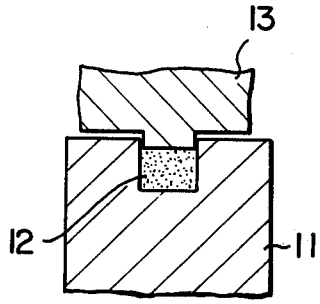
FIG. 3 is a sectional view taken on line A–A′ of FIG. 2.
Figure 2:
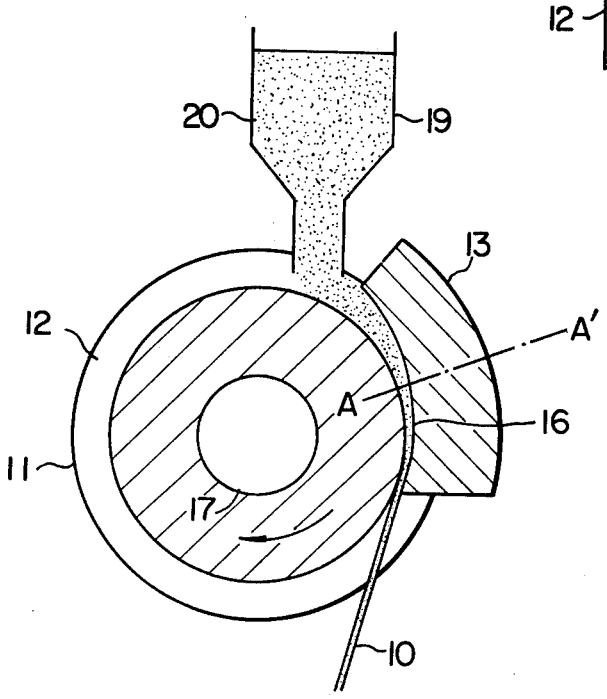

Therefore, a process was developed for the production of the wires according to this invention, and this process is illustrated in FIGS. 2 and 3. In FIG. 2, 11 is a movable wheel having on its peripheral surface an endless groove 12 with a cross section shown in FIG. 3. A fixed block 13 is engaged with the movable wheel 11 in such a way that a tapered path 16 is formed between the endless groove 12 of the movable wheel 11 and the engaging face of the fixed block 13. The cross section of the path 16 diminishes in the direction of rotation of the movable wheel 11 indicated by the arrow. Also, 17 is a driving shaft and 19 is a hopper.

The metal powder or metal powders 20 are charged into the path 16 through the hopper 19. When the movable wheel 11 is rotated in the direction of the arrow, the metal powder or powders are transferred through the path 16 and as the cross section of the path 16 diminishes the powder or powders are compacted leaving the path 16 at its exit, where the path has its smallest cross section, as a compacted wire 10. The advantage of this method is that the amount of compaction applied can be adjusted to just the level required to obtain a compacted wire of the present invention and that undue shearing forces, which increase the temperature of the compacted powders, are avoided.

The wire thus produced can further be formed by conventional means such as rolling or drawing to obtain the round shape and the diameter required for flame spraying.

Figure 4:
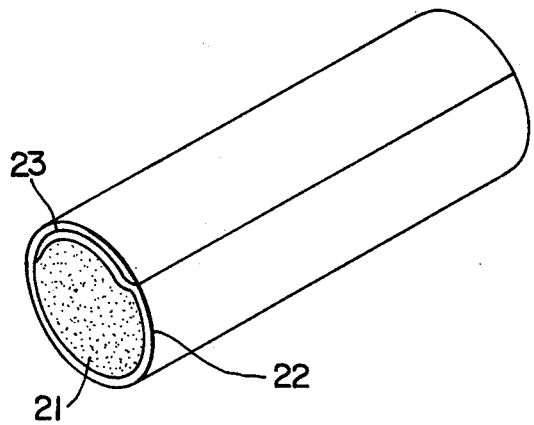

FIG. 4 shows a zinc-aluminum flame spraying material consisting of a composite wire 20 produced by providing an aluminum tape covering 22 onto a core material 21 consisting of compacted zinc powder or admixed powders of zinc and aluminum or a powder of a zinc-aluminum alloy. In the covering 22, an overlap 23 of the side edges of the tape having a certain angle extends almost linearly in the axial direction. The covering 22 is thicker at this overlapping part 23 than at the other parts. Since this overlap 23 is formed when the aluminum tape is molded into a tubular form and tightly formed around the core material 21, the overlap 23 does not open so long as it has a certain angle as seen on the cross section of the wire. When this composite wire is flame sprayed, the aluminum covering 22 and the core material 21 melt together and after alloying are atomized. Thus a flame sprayed coating of the desired composition can be obtained.

Figure 5:
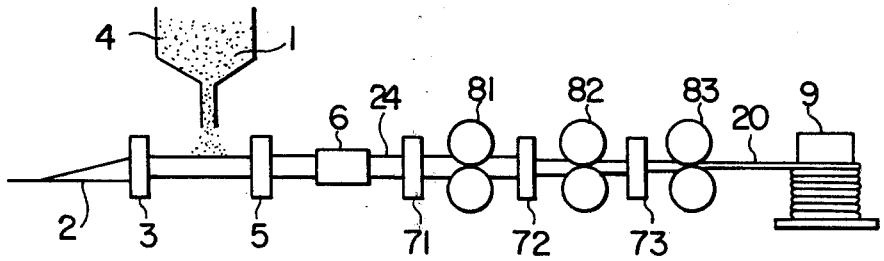

The composite wire 20 having the structure shown in FIG. 4 can be produced by the process as shown in FIG. 5. An aluminum tape 2 as a covering material with a predetermined width is continuously bent to form a semicircular channel of U-shape in the length direction of the tape by a molding die 3, and then led to a lap roller 6 through a scraper die 5 as it is. As a result, the tape 2 bent and molded into a U-form is converted into a tube 24 wherein one side edge thereof is overlapped on another side edge thereof. The scraper die 5 acts as a means for maintaining a fixed amount of metal powder or metal powders 1 supplied through a powder supply apparatus 4 such as a hopper onto the moving tape 2 while the tape is molded into a U-form. The tube 24 leaving the lap roller 6 is subjected to compression means consisting of a combination of dies 71, 72 and 73 and rollers 81, 82 and 83. Thus, a composite wire 20 having an appointed size is produced and is wound up by a coiler 9.

While the tube 24 containing the powder or powders 1 is passed through the respective dies and rollers, the powder or powders 1 to be a core material 21 are gradually compressed to a compacted state. Hereby, the aluminum tape 2 as a covering material is formed and pressed from around. Therefore, the tape adheres tightly at the overlap 23 and also tightly encloses the core material 21.

Alternatively, the composite wire 20 can be produced by forming a core material 21 from the metal powder or metal powders 1 by a powder compaction process as shown in FIG. 4 and then covering this core wire with an aluminum tape in the same way as described above. (The detailed explanation of this alternative process is omitted here.)

The following examples illustrate the present invention, but the examples should not be construed to limit the invention.

EXAMPLE 1

Admixed powders consisting of 70% by weight of zinc powder and 30% by weight of aluminum were continuously subjected to compaction processing and molding to obtain a wire of 3.15 mm in diameter. With regard to the state of diffusion of aluminum and zinc in this wire, the distribution of aluminum particles and zinc particles was examined by an X-ray microanalyzer. As a result, it was found that aluminum and zinc were bonded to one another only on the surface layer of the respective particles by diffusion and were not alloyed as a whole. Then, flame spraying tests were carried out using the thus compaction processed wire. As a result, it was found that its flame spraying properties were good and the flame spraying material had been alloyed in the flame sprayed layer.

EXAMPLE 2

Three composite wires having a properly large overlap and different coating thicknesses were produced by using zinc powders as a raw material for a core material and aluminum tapes of 0.25 mm, 0.4 mm and 0.45 mm in thickness, respectively, as a coating material according to the process as shown in FIG. 5. The three composite wires each had a composition consisting of 74% by weight of zinc and 26% by weight of aluminum. Flame spraying operability test and performance test were carried out with regard to these composite wires. As a result, it was found that the composite wire produced with an aluminum tape of 0.45 mm in thickness was not practicable as it gave a proper smooth flame sprayed surface appearance only when the flame spraying velocity was very low.

Flame spraying velocity increased with decreasing thickness of the aluminum covering. For the wire produced with an aluminum tape of 0.4 mm thickness the flame spraying velocity was about $\frac{1}{3}$ of the velocity obtained with zinc or a Zn-15% Al alloy wire used as comparative material. For a thickness of the covering of 0.25 mm the flame spraying velocity was the same as for the comparative materials. In all cases the wires completely alloyed during flame spraying at the appropriate velocity and then a flame sprayed coating of good surface quality and the desired alloy composition was obtained.

In Examples 1 and 2, the preparation of flame spraying wires was very efficient as a whole. Particularly, the operation of producing composite wires in Example 2 was efficient. It goes without saying that the composition of the alloy obtained on flame spraying can be regulated in the composite wires of Example 2 by adding aluminum powder to the core material.

Figure 6:
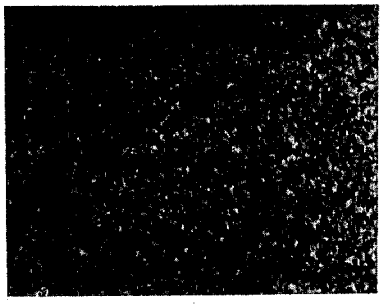
FIG. 6 shows photographs of the X-rays brightness distribution of zinc and aluminum in a composite flame spraying wire according to the present invention.
Figure 6:
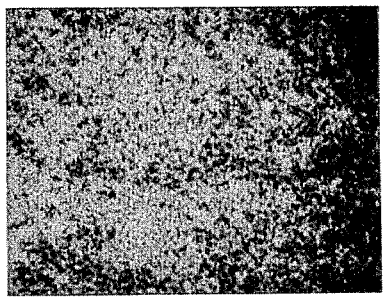
Figure 6:
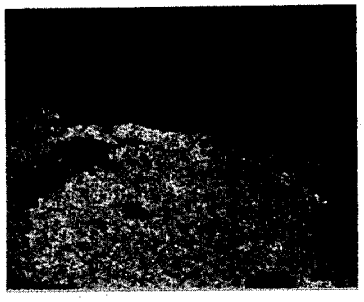
Figure 6:
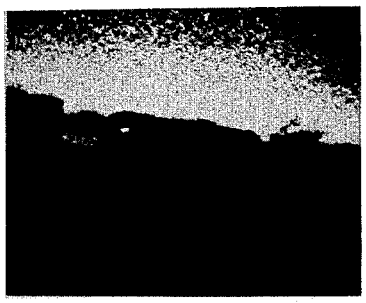

FIG. 6 shows the X-ray brightness distributions of zinc and aluminum, respectively, at longitudinal section parts of the tip (A) and a certain distance from the tip (B) of a zinc-aluminum composite flame spraying wire after flame spraying. That is to say that the tip (A) of the wire was already melted by the flame spraying operation, the part shown in (B) was unaffected by the flame spraying operation.

The X-ray brightness distributions were obtained by the use of an X-ray microanalyzer. In the photographs of FIG. 6, white parts show the presence of zinc and aluminum, respectively. As is clear from FIG. 6, zinc and aluminum exist separately at the definite distance from the tip but they exist together at the tip portion. Thus, it was established that the metals are alloyed in the composite wire on flame spraying.

EXAMPLE 3

Two composite wires having a diameter of 3.15 mm and an overlap size of 30° and 90°, respectively, as an angle on the cross section were produced with zinc powder as a material for the core and aluminum tapes of 0.3 mm and 0.25 mm in thickness, respectively, as a covering material.

The composite wire having an overlap size of 30° had a defect in that the overlap opened during feeding the wire to the flame spraying gun. Also, the composite wire having an overlap size of 90° permitted normal flame spraying.

Figure 7:
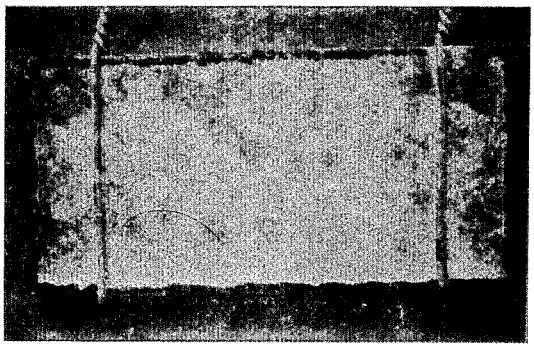
FIG. 7 shows photographs showing the results of salt spray test for a flame spraying wire according to the present invention.
Figure 7:
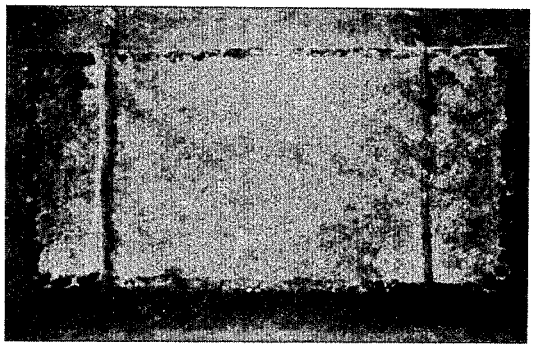
Figure 7:
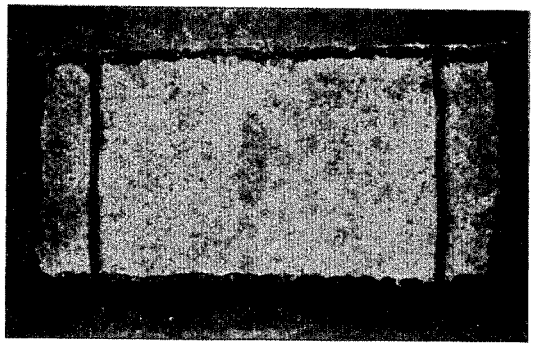

FIG. 7 shows salt spray test results of the test material, flame sprayed under the flame spraying conditions as shown in the table below, after 30 weeks.

In the salt spray test, zinc began to be dissolved on the zine flame sprayed surface already after 13 weeks. It was found that the dissolution of zinc increased with the lapse of time. On the other hand, it was found that the Zn-26% Al composite flame sprayed surface and the Zn-15% Al alloy flame sprayed surface did not rust even after 30 weeks and displayed satisfactory corrosion protecting effect.

| Flame Spraying Conditions | |
|---|---|
| Substrate | Steel plate |
| Flame spraying wire | Zn-26% Al composite wire, 3.15 mm Φ Zn wire, 3.15 mmΦ Zn-15% Al alloy wire (comparative material), 3.15 mmΦ |
| Pretreatment | Grid blast |
| Flame spraying apparatus | Apparatus generally used in zinc flame spraying |

As is clear from the above explanation, the flame spraying materials according to the present invention can be produced by subjecting a metal powder or metal powders to compaction processing. Therefore, they can be produced efficiently without causing a problem of zinc diffusion or a problem of bittleness at high temperatures. Also, it is very easy to regulate the ratio of the components and flame spraying materials can be obtained which are excellent in corrosion resistance and high in aluminum content. Further, their flame spraying properties are the same as those of prior art alloy wires. Therefore, the present invention is advantageous in that the production of flame spraying materials is easy and effective flame spraying materials can be provided at a low cost. The present invention shows a remarkable improvement in the state of art.

What is claimed is:

1. A flame spraying material in the form of a composite wire comprising zinc and aluminum and consisting of a core of compacted powders of zinc, or a zinc-aluminum alloy or of compacted admixed powders of zinc and aluminum, said core being tightly envelopec by a covering material consisting of aluminum whereby said covering material has a higher melting point and higher thermal conductivity than said core.

2. A wire shaped flame spraying material as claimec in claim 1, wherein said covering of aluminum has ε thickness of 0.4 mm or less.

3. A wire shaped flame spraying material as claimed in claim 1, wherein said wire-shaped flame spraying material is adapted to form an aluminum-zinc alloy flame sprayed coating.

4. A wire shaped flame spraying material as claimed in claim 1, wherein said covering material is a tape of aluminum tightly formed around said core in such a way that the edge portions of said tape overlap each other and this overlapping portion is essentially aligned parallel to the longitudinal axis of the wire.

5. A wire shaped flame spraying material as claimed in claim 4, wherein said overlapping portion of said aluminum tape has a circumferential extent of more than 45 degrees as seen in the transverse cross section of the composite wire.

6. A wire shaped flame spraying material as claimed in claim 4, wherein said overlapping portion of said aluminum tape has a circumferential extent in the range between 340 degrees and 380 degrees as seen on the transverse cross section of the composite wire.

7. A method of production of a wire shaped flame spraying material comprising zinc or zinc and aluminum and consisting of a compacted powder of zinc or zinc-aluminum alloy powder or compacted admixed powders of zinc and aluminum, which method comprises the steps of:

(a) rotating a movable wheel, having an endless groove at its peripheral surface;

(b) charging said powders into a path formed by said groove of said movable wheel and a fixed block member, which member adjoins and slightly extends in the groove of said movable wheel for a part of the circumference of said movable wheel in such a way that the path thus formed diminishes in cross section in the direction of rotation of said movable wheel;

(c) moving said powders through said path by sliding frictional force generated by the rotation of the movable wheel and pressing said powders through the opening of said path with minimum cross section; and (d) further forming the compacted wire to obtain a wire of suitable shape and diameter.

8. A method as claimed in claim 7, wherein said compacted wire formed in (d) is adapted to be covered with an aluminum tape, whereby said compacted wire formed in (d) would be a core of a wire shaped flame spraying material, which core is tightly enveloped by a covering material consisting of aluminum.

9. A method of production of a wire shaped flame spraying material as claimed in claim 7, wherein an organic binder is admixed to said powders prior to charging in said path, whereby the powders are bonded to each other in the compacted powder by the organic binder.

10. A method as claimed in claim 9, wherein said organic binder is selected from the group consisting of polyethylene, polyvinyl alcohol and cellulose acetate.

11. A method of production of a flame spraying material in the form of a composite wire comprising zinc and aluminum and consisting of a core of compacted powders of zinc, or a zinc-aluminum alloy or of compacted admixed powders of zinc and aluminum, said core being tightly enveloped by a covering material consisting of a tape of aluminum, whereby said covering material has a higher melting point and higher thermal conductivity than said core, which method comprises the steps of:

(a) continuously forming said tape of aluminum of predetermined width into a semicircular channel;

(b) continuously charging a predetermined amount of said powders into said semicircular shaped channel;

(c) further forming continuously said tape around said powders by suitable forming devices in such a way that the tape tightly encloses the powders and the edge portions of said tape overlap each other, and this overlapping portion is essentially aligned parallel to the longitudinal axis of the composite wire thus obtained; and (d) further reducing the cross section of the composite wire to a predetermined diameter.

12. A method as claimed in claim 11, wherein the said tape of aluminum has a thickness of 0.4 mm or less.

13. A method as claimed in claim 11, wherein said tape of aluminum is formed around said powders in such a way that the edge portions of said tape overlap each other and this overlapping portion has a circumferential extent of more than 45 degrees as seen in the transverse cross section of the composite wire.

14. A method as claimed in claim 11, wherein said tape of aluminum is formed around said powders in such a way that the edge portions of said tape overlap each other and this overlapping portion has a circumferential extent in the range between 340 degrees and 380 degrees as seen in the transverse cross section of the composite wire.

* * * * *